US007554387B1

(12) United States Patent
Sakurai

(10) Patent No.: US 7,554,387 B1
(45) Date of Patent: Jun. 30, 2009

(54) PRECISION ON CHIP BIAS CURRENT GENERATION

(75) Inventor: Satoshi Sakurai, San Diego, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 12/038,125

(22) Filed: Feb. 27, 2008

(51) Int. Cl.
*G05F 1/10* (2006.01)

(52) U.S. Cl. ..... 327/538

(58) Field of Classification Search ..... 327/513, 327/535, 537, 538, 539, 543
See application file for complete search history.

(56) References Cited

U.S. PATENT DOCUMENTS 5,300,837 A * 4/1994 Fischer ..... 327/281
5,777,509 A * 7/1998 Gasparik ..... 327/542
6,570,436 B1 * 5/2003 Kronmueller et al. ..... 327/538
6,940,338 B2 * 9/2005 Kizaki et al. ..... 327/543
7,365,594 B2 * 4/2008 Kojima et al. ..... 327/538
7,514,980 B2 * 4/2009 Choi et al. ..... 327/346

* cited by examiner

*Primary Examiner*—Jeffrey S Zweizig

(57) ABSTRACT

Bias current generation circuits and systems are disclosed. In one embodiment, a bias current generation system comprises a current generation circuit generating a first current based on a first voltage and an external resistor, a current mirror forwarding a second current proportional to the first current, and one or more bias current generation circuits with each circuit generating a bias current based on a second voltage over a resistance of a transistor device, where the transistor device is maintained in a triode region using a third voltage associated with the second current and where the resistance of the transistor device shares characteristics of a resistance of the external resistor.

20 Claims, 6 Drawing Sheets

200

PRECISION ON CHIP BIAS CURRENT GENERATION

FIELD OF TECHNOLOGY

This disclosure relates generally to a bias generation circuit and system.

BACKGROUND

An on chip bias current is used to operate internal circuit components. The on chip bias current is generated by dividing an internal voltage of the chip with respective internal resistance. The voltage used for the on chip bias current can be constant over temperature to generate a constant current, or it can be proportional to temperature to generate a PTAT current.

FIG. 1 illustrates a circuit internal to a chip 102 that generates a constant current 106. In FIG. 1, an internal voltage (Vbg) which is independent of temperature can be generated using a bandgap circuit. Then, this voltage is applied across an internal resistor R0, thus generating a constant current 104 (e.g., Vbg/R0) which flows through the resistor R0, a transistor M1 and a transistor M2. The constant current 106 is proportional to the constant current 104 where the proportion between the two currents is determined by a current mirror consisting of the transistor M2 and a transistor M3. With the ratio of M3 to M2 being a constant K, then the constant current 106 become K*Vbg/R0. The equation illustrates that the constant current 106 can be process dependent and temperature dependent due to the resistor R0 which possesses such characteristics.

FIG. 2 illustrates a typical circuit internal to a chip 202 that generates a PTAT current 206. It is well known in the art that the difference in the base to emitter voltages of the two PNP BJTs (e.g., P1 and P2) is proportional to the temperature of the circuit. That is, V2=V1=Ve1, and a PTAT current 204 crossing a resistor R1 is obtained by (Ve1−Ve2)/R1=(Vbe2−Vbe1)/R1. The PTAT current 206 is proportional to the PTAT current 204 where the proportionality is determined by the current mirror consisting of a transistor T1, a transistor T2 and a transistor T5. In this circuit, the resistor R1 is process and/or temperature dependant.

A typical internal resistor used for the current generation may have resistance that depends on process variations as well as the operating conditions such as temperature and voltage across the resistor. The variations in resistance can become as much as ±30%. An external resistor may be used in place of the internal resistor to decrease the effect of the internal resistor on the bias current. However, such scheme may add extra pins and/or components to the circuits, thus adding to the cost and increasing the size of the circuit. The cost may become even greater if more than one current needs to be generated.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

An embodiment described in the detailed description is directed to a bias current generation system which comprises a current generation circuit generating a first current based on a first voltage and an external resistor and a current mirror forwarding a second current proportional to the first current. The system further comprises one or more bias current generation circuits with each circuit generating a bias current based on a second voltage over a resistance of a transistor device, where the transistor device is maintained in a triode region using a third voltage associated with the second current and where the resistance of the transistor device shares characteristics of a resistance of the external resistor.

As illustrated in the detailed description, other embodiments pertain to electronic circuits and systems that reduce the effect of on chip resistance variation on the internal bias current by using an internal component replicating external resistance. By implementing the component in a constant current source and a PTAT current source, the embodiments generate more accurate bias currents which are not affected by the resistance variation due to the process or temperature variations.

BRIEF DESCRIPTION OF THE DRAWINGS

Example embodiments are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Briefly stated, embodiments reduce the effect of on chip resistance variation on the internal bias current by using an internal component which replicates external resistance. In addition, the internal component can be used to generate different types of the internal bias current such as a PTAT current and a constant current.

Figure 1:
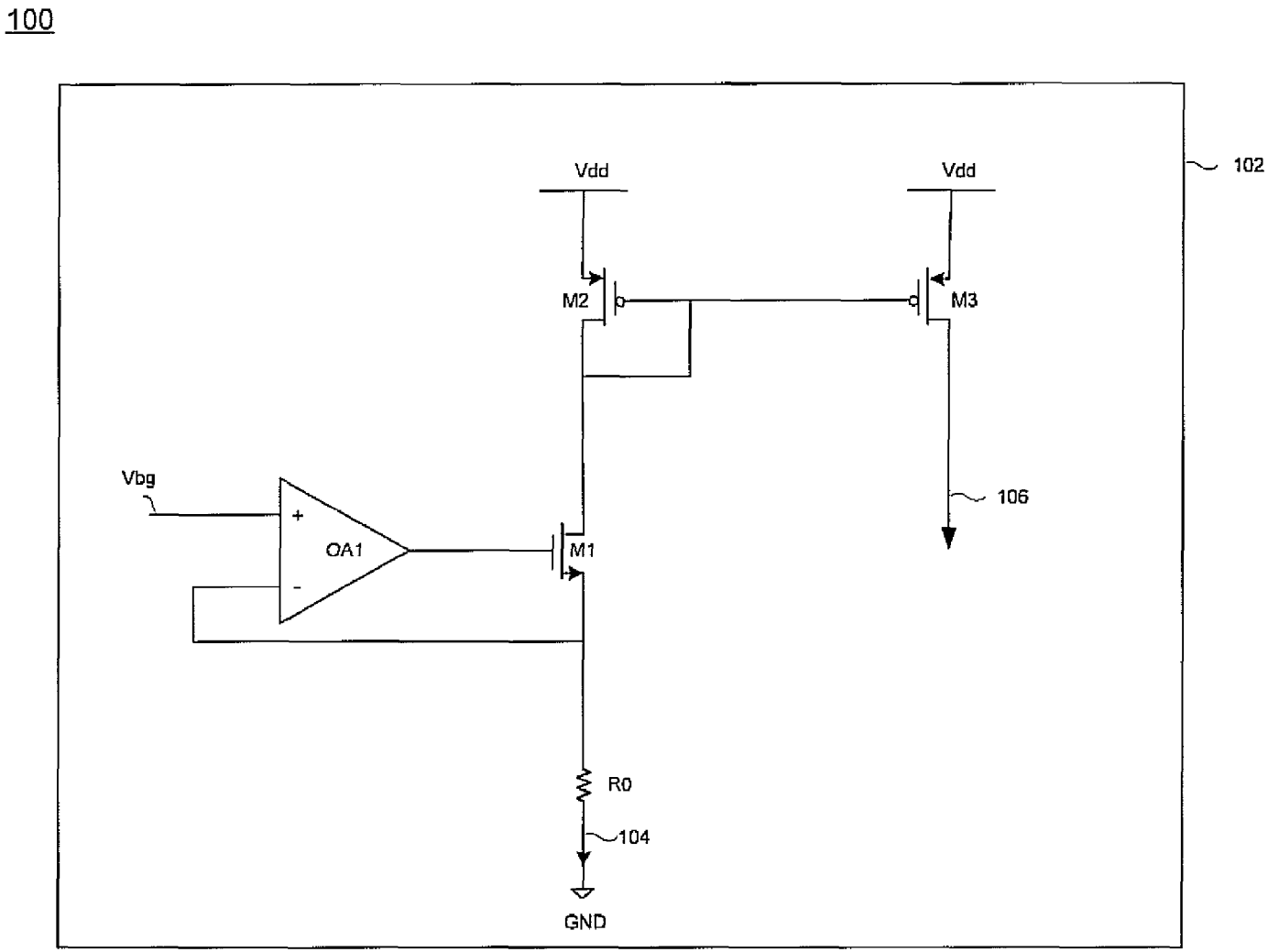
FIGURE 1 (CONVENTIONAL ART)
FIG. 1 is a circuit diagram of an on chip constant current source.
Figure 2:
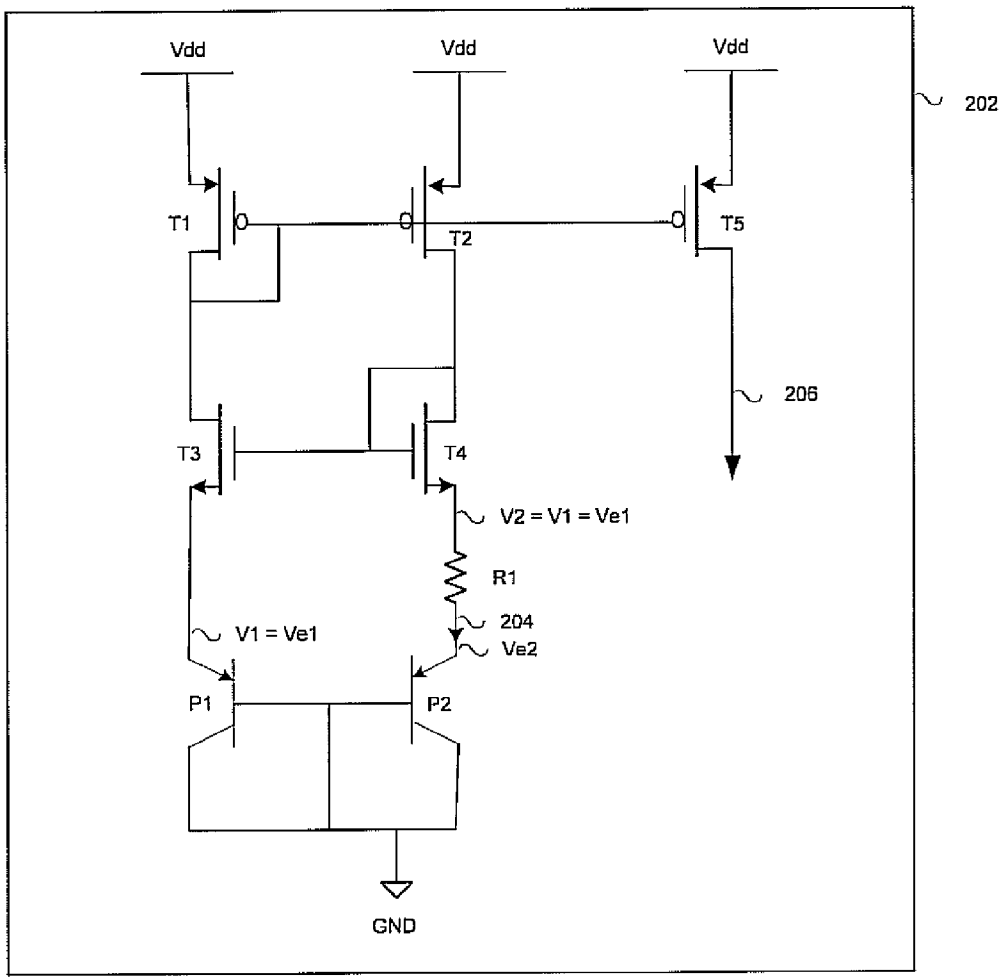
FIGURE 2 (CONVENTIONAL ART)
FIG. 2 is a circuit diagram of an on chip PTAT current source.
Figure 3:
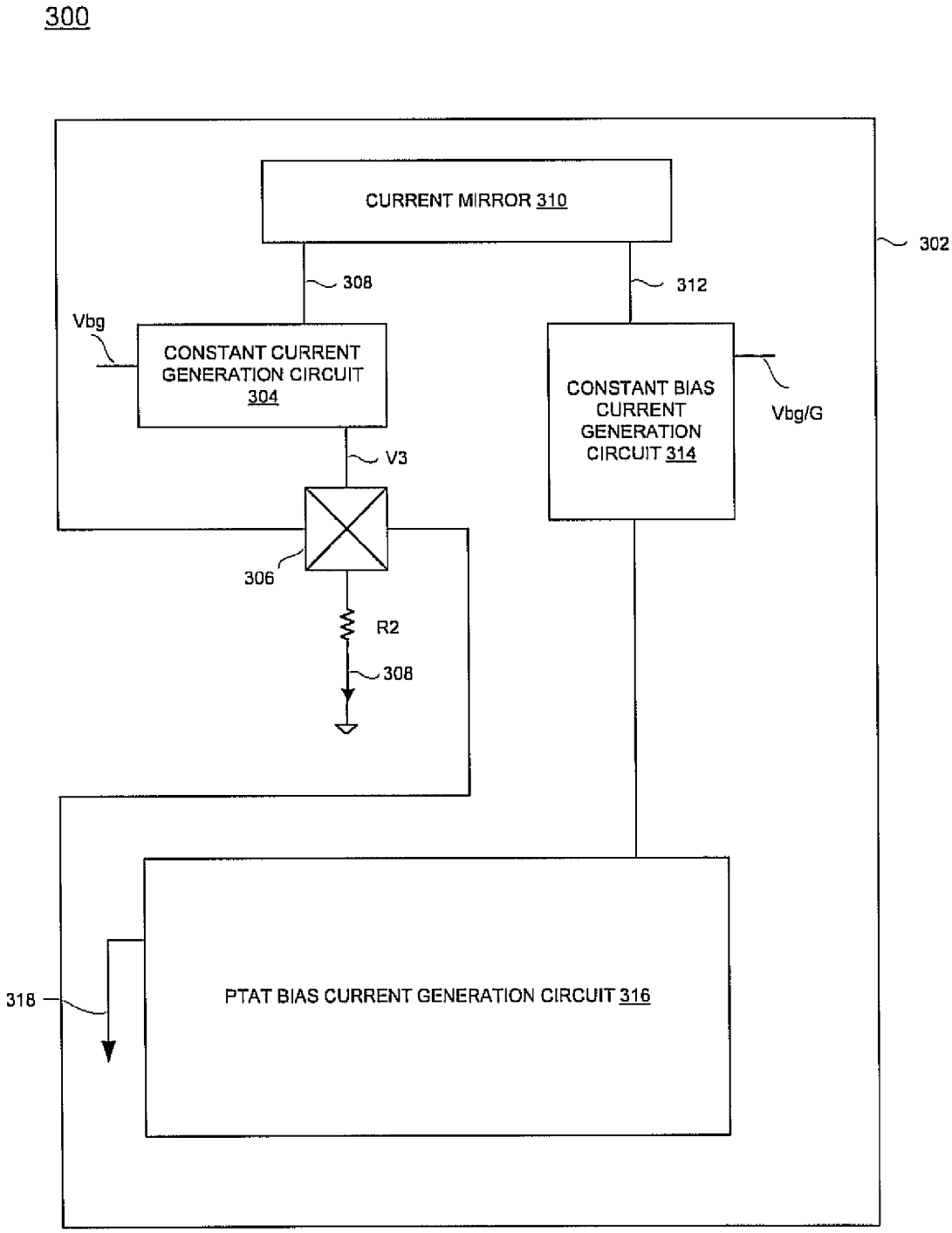
FIG. 3 is an exemplary block diagram of a system generating a constant current and a PTAT current which replicates external resistance, according to one embodiment.

FIG. 3 is an exemplary block diagram of a system generating a constant current and/or a PTAT current through replicating external resistance, according to one embodiment. A system 302 includes internal components and an external resistor 308 coupled to the internal components through a pin 306. In FIG. 3, a constant voltage generation circuit 304 uses a bandgap voltage Vbg to generate a constant voltage output V3. The constant voltage generation circuit V3 is coupled the external resistor R2 (e.g., a carbon based resistor, a metal resistor, a foil resistor, etc.) through the pin 306. A constant current 308 flowing through the external resistor R2 is less dependent on temperature and/or process than the system which uses an internal resistor as illustrated in FIG. 1.

A current mirror circuit 310 forwards a constant current 312 which is proportional to the constant current 308 to a constant bias current generation circuit 314. It is appreciated that the amount of the constant current 312 depends on the type of current mirror circuit 310 in the system. The constant current 312 is less dependent on the manufacturing process of the constant current source since the external resistor R2 is not affected by much of the manufacturing process. That is, the external resistor R2 does not have to be as small as the internal resistor (e.g., the internal resistor R0 of FIG. 1) it is replacing. In addition, the constant current 312 is less dependent on the temperature of the system 302 since the external resistor R2 is less dependant on the temperature than the internal resistor.

Figure 4:
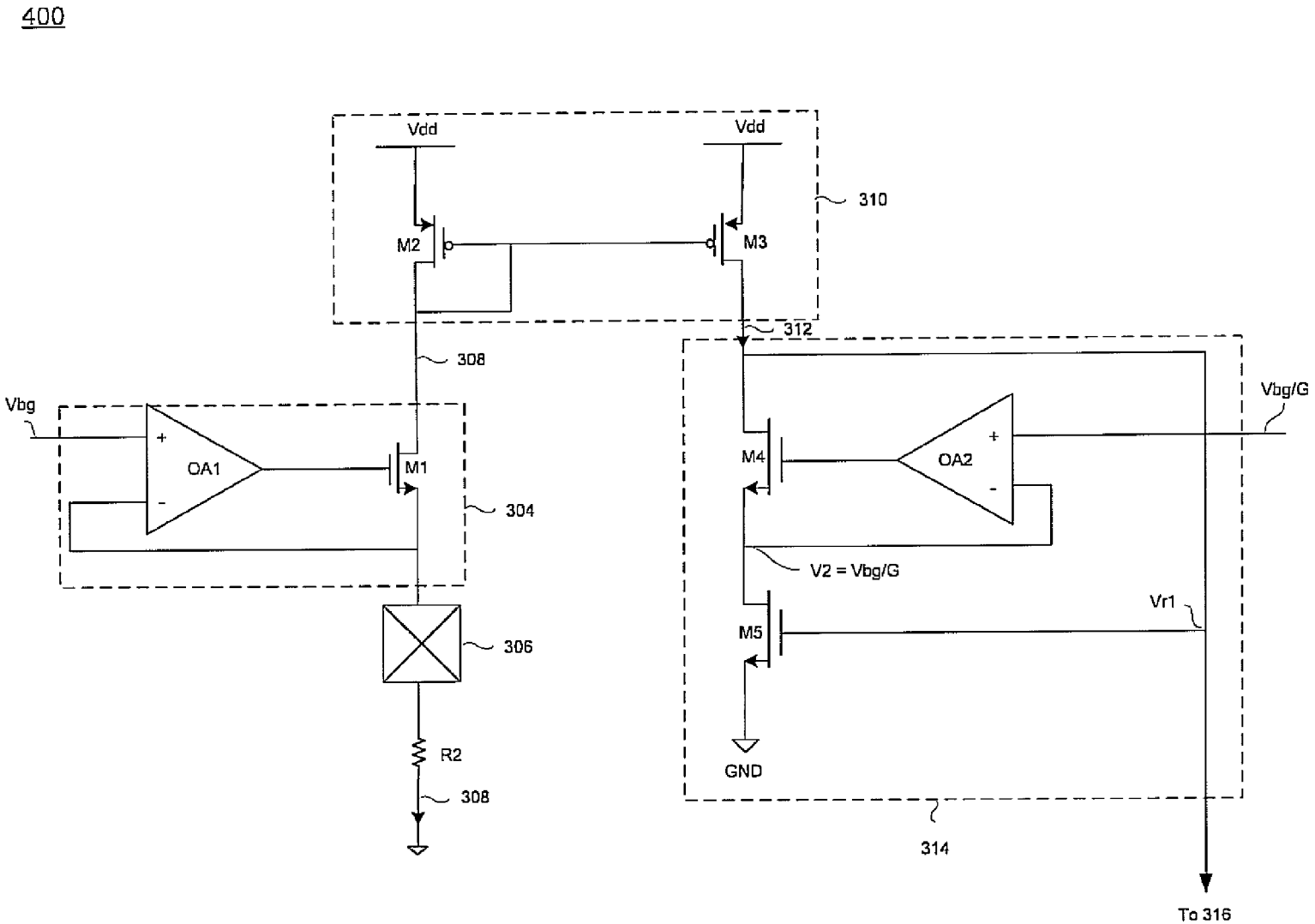
FIG. 4 is an exemplary circuit diagram of a constant current source which replicates external resistance, according to one embodiment.

The constant bias generation circuit 314 replicates the external resistor R2 in its entirety or proportion as will be illustrated in more detail in FIG. 4. A PTAT bias current generation circuit 316 replicates the external resistor R2 in its entirety or in proportion as will be illustrated in more detail in FIG. 5.

In one exemplary embodiment, a bias current generation system comprises a current generation circuit generating a first current based on a first voltage (e.g., a reference voltage) and an external resistor, a current mirror forwarding a second current proportional to the first current, and one or more bias current generation circuits with each circuit generating a bias current based on a second voltage over a resistance of a transistor device, where the transistor device is maintained in a triode region using a third voltage associated with the second current and where the resistance of the transistor device replicates a resistance of the external resistor in proportion. It is appreciated that the reference voltage may be one of many different types of voltage depending on the bias current generation circuits being implemented on the chip.

In one exemplary embodiment, the constant current generation circuit comprises a feedback amplifier coupled to a first transistor device and the external resistor coupled to the first transistor device, where the first voltage is an input to the feedback amplifier and where the first transistor device forwards the first current. The external resistor may be coupled to a node of the first voltage via an external pin and/or the first current may be equivalent to the second current.

In one exemplary embodiment, the circuits comprises a constant bias current generation circuit which includes a first transistor device and the transistor device coupled in series and a feedback amplifier coupled to the first transistor device and to the transistor device, where a fraction of the first voltage is an input to the feedback amplifier and where the second current is the bias current. The first voltage may be a bandgap voltage independent of temperature. The fraction of the first voltage may be obtained using a resistance divider circuit.

In one exemplary embodiment, the circuits comprises a PTAT current generation circuit which includes a first BJT device, a first CMOS device and a third CMOS device coupled in series, a second BJT device, a second CMOS device and a fourth CMOS device coupled in series, and a third BJT device and a fifth CMOS device coupled ins series, where a source of the third BJT device is coupled to a gate of the transistor device and where the bias current is based on a different between a base-to-emitter voltage of the first BJT device and a base-to-emitter voltage of the second BJT device over the resistance of the transistor device.

FIG. 4 is an exemplary circuit diagram of a constant current source which replicates external resistance, according to one embodiment. FIG. 4 illustrates a circuit which generates a temperature independent bias current by using the external resistor R2 and the pin 306. The constant current 308 is a temperature independent bias current which equals Vbg/R2. The constant current 312 is a mirrored version of the constant current 308 and can have a value proportional to the constant current 308. In one exemplary embodiment, the constant current 308 and the constant current 312 is equal.

The constant current 312 sources a transistor M4 and a transistor M5. Using an amplifier OA2 in a feedback configuration, a voltage V2 between the transistor M4 and the transistor M5 becomes Vbg/G where G is constant. Thus, the effective resistance of the transistor M5 replicates or shares characteristics of the resistance of the external resistor R2. That is, the transistor M5 also becomes independent of process variations and/or conditional variations. It is appreciated that the transistor M5 needs to remain in the triode region and acts as a resistor. That is, G needs to be chosen to keep the voltage V2 low enough to keep the transistor M5 in the triode region.

Since the constant current 308 is equal to the constant current 312 if the current mirror 310 is a unity gain current mirror, a voltage Vr1 at the gate of the transistor M5 will adjust itself to maintain the following relationship:

I2=V2/Reff5 and I1=Vbg/R2, where I2 is the constant current 312, Reff5 is the effective resistance of the transistor M5 and I1 is the constant current 308. Moreover, if I1 is set to equal I2, G*Reff5=R2 and Reff5=R2/G, where the transistor M5 is an internal device with an effective resistance of R2/G which is maintained over process variations and operating conditions.

G can be generated internally by using a resistor divider. Since the resistor divider uses the ratio of resistors rather than their absolute values, it would not contribute to the process variations or to the operating conditions.

Thus, the constant current 312 (I2) is a current which is not affected by the process variations or operating conditions since it is equal to Vbg/G*Reff5, where Vbg, G and Reff5 are well maintained over the process variations and/or operating conditions.

Figure 5:
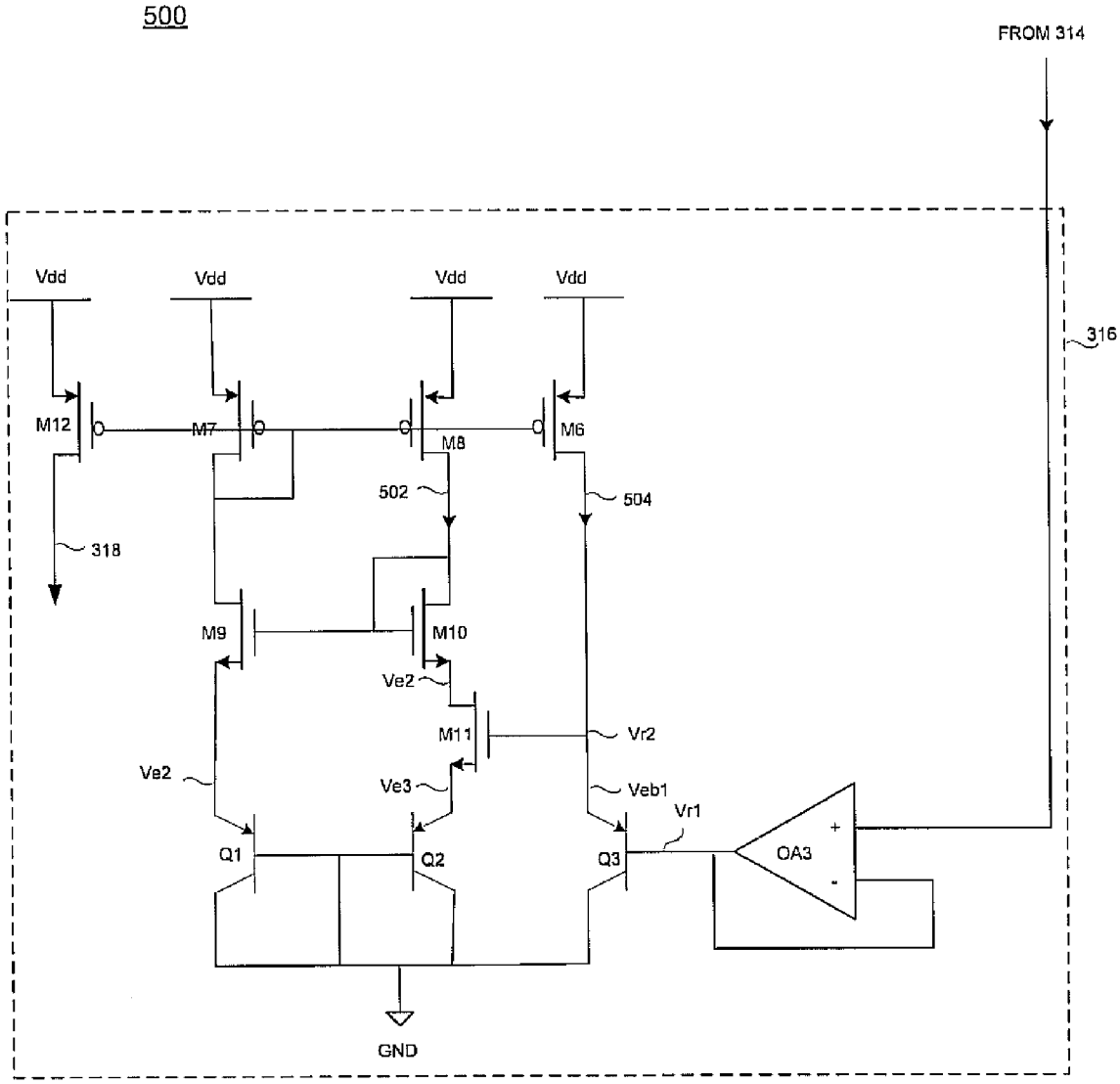
FIG. 5 is an exemplary circuit diagram of a PTAT current source which replicates external resistance, according to one embodiment.

FIG. 5 is an exemplary circuit diagram of a PTAT current source which replicates external resistance, according to one embodiment. The PTAT current source comprises a PNP BJT Q1, a NMOS M9 and a PMOS M7 coupled in series and a PNP BJT Q2, a NMOS M10 and a PMOS M8 coupled in series. The collector and base of the PNP BJT Q1 is coupled to the ground, its emitter connected to the source of the NMOS M9. The collector and base of the PNP BJT Q2 is connected to the ground and its emitter connected to a transistor M11, which is connected to the source of the NMOS M10. In addition, the gate of the NMOS M9 is connected to the gate and drain of the NMOS M10. The gate of the PMOS M7 is connected to its drain and to the gate of the PMOS M8. The source the PMOS M7 and the source of the PMOS M8 are connected to a positive supply voltage (e.g., the Vdd).

The PTAT current source generates a current proportional to absolute temperature. Accordingly, the PTAT current 318 via a PMOS M12 or a PTAT current 504 via a PMOS M6 is proportional to a PTAT current 502 via the transistor M11 if the transistor M11 acts as a resistor.

In FIG. 5, a PTAT current 502 is generated by dividing (Ve2-Ve3)/Reff11, where Ve2 is the emitter voltage of a transistor Q1, Ve3 is the emitter voltage of a transistor Q2 and Reff11 is the effective resistance of a transistor M11. In one exemplary embodiment, Reff11 is made to equal or proportional to Reff5. Thus, the transistor M11 replicates or shares characteristics of the resistance of the external resistor R2. That is, the effective resistance of the transistor M11 also becomes independent of process variations and/or conditional variations. This requires Vgs11 to equal or proportional to Vgs5, where Vgs11 is the gate to source voltage of the transistor M11 and Vgs5 is the gate to source voltage of the transistor M5.

By selecting a transistor Q3 same as the transistor Q2 and by setting the PTAT current 502 equal to a PTAT current 504, $$Vgs11=Vr2-Ve3=Vr1+Veb1-Veb3=Vr1=Vgs5.$$

It is appreciated that an amplifier OA3 is used to absorb the base current of the transistor Q3 while maintaining the output node of the amplifier OA3 equal to Vr1.

In one exemplary embodiment, in order to have a good matching between the transistor M5 and the transistor M11, the gate lengths of the devices are kept same. With the gate width of the transistor M5 and M11 begin Wr1 and Wr2, respectively, Reff11 is given as Reff11=Reff12*Wr1/Wr2=(Wr1/Wr2)*R2/G, where R2 is the external resistor, and each of Wr1/Wr2 and G is a ratio of internal components. Thus, the effective resistance of the transistor M11 is not dependent on process or temperature variations.

With Reff11 defined, the PTAT current 318 can be calculated to be $$Iout=K*I3=K*(Vbe3-Vbe2)/Reff11=K*G*(Vbe3-Vbe1)/(R2*(Wr1/Wr2)),$$ where Iout is the PTAT current 318, I3 is the PTAT current 502.

Thus, the PTAT current 318 is set by the external resistor R2 and scaling constants generated internally. Moreover, the scaling constants can be selected to generate appropriate amount of current needed by the chip.

Figure 6:
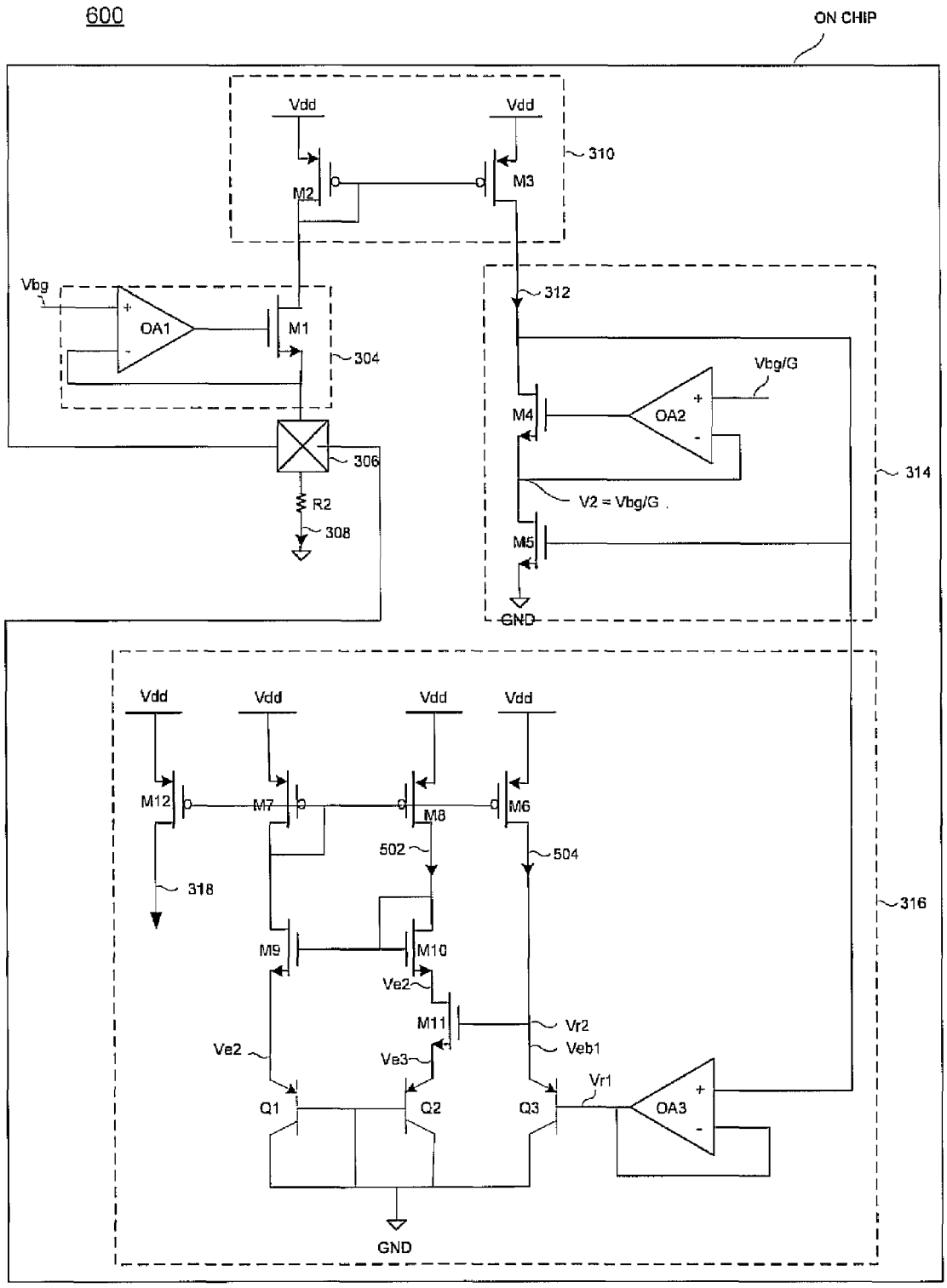
FIG. 6 is an exemplary circuit diagram of a constant current source and a PTAT current source which replicate external resistance, according to one embodiment.

FIG. 6 is an exemplary circuit diagram of a constant current source and a PTAT current source, according to one embodiment. It is appreciated that one or more bias currents can be generated by replicating external resistance so that the bias currents are less dependant on the manufacturing process and temperature variations. FIG. 6 illustrates one exemplary embodiment which generates a PTAT current and a constant current using single voltage source and single external resistance. It is appreciated that more temperature and/or process independent currents can be generated by replicating external resistance in the similar manner as in FIG. 6.

In one exemplary embodiment, a bias current generation system comprises a constant current generation circuit generating a first constant current based on a first constant voltage and an external resistor, a current mirror forwarding a second constant current proportional to the first constant current, a constant bias current generation circuit generating a constant bias current based on a second constant voltage over a resistance of a first transistor device, where the first transistor device is maintained in a triode region using a third constant voltage associated with the second constant current and where the resistance of the first transistor device replicates a resistance of the external resistor in proportion, and a PTAT bias current generation circuit generating a PTAT bias current based on a first PTAT voltage over a resistance of a second transistor device, where the second transistor device is maintained in a triode region and where the resistance of the second transistor device replicates a resistance of the external resistor in proportion.

In one exemplary embodiment, the constant current generation circuit comprises a feedback amplifier coupled to a third transistor device and the external resistor coupled to the third transistor device, where the first constant voltage is an input to the feedback amplifier and where the third transistor device forwards the first constant current.

In one exemplary embodiment, the constant bias current generation circuit comprises a third transistor device and the first transistor device coupled in series and a feedback amplifier coupled to the third transistor device and the first transistor device, where a fraction of the first constant voltage is an input to the feedback amplifier and where the second constant current is the constant bias current. The fraction of the first constant voltage may be obtained using a resistance divider circuit.

In one exemplary embodiment, the PTAT current generation circuit comprises a first BJT device, a first CMOS device and a third CMOS device coupled in series, a second BJT device, a second CMOS device and a fourth CMOS device coupled in series, and a third BJT device and a fifth CMOS device coupled in series, where an emitter of the third BJT device is coupled to a gate of the second transistor device and where the PTAT bias current is based on a different between a base-to-emitter voltage of the first BJT device and a base-to-emitter voltage of the second BJT device over the resistance of the second transistor device. The constant bias current generation circuit may be coupled to the PTAT bias current generation circuit via a feedback amplifier. The resistance of the first transistor device may be proportional to the second transistor device.

In one exemplary embodiment, the resistance of the first transistor device may be proportional to the second transistor device. The gate length of the first transistor device is same as the gate length of the second transistor device. Accordingly, a ratio of the resistance of the first transistor device to the resistance of the second transistor device is determined by a gate width of the first transistor device and a gate width of the second transistor device. Other features of the present embodiments will be apparent from the accompanying drawings and from the detailed description that follows.

In summary, embodiments described herein pertain to electronic circuits and systems that reduce the effect of on chip resistance variation on the internal bias current by using an internal component replicating external resistance. By implementing the component in a constant current source and a PTAT current source, the embodiments generate more accurate bias currents which are not affected by the resistance variation due to the process or temperature variations.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A bias current generation system, comprising:

a current generation circuit generating a first current based on a first voltage and an external resistor;

a current mirror forwarding a second current proportional to the first current; and at least one bias current generation circuit generating a bias current based on a second voltage over a resistance of a transistor device, wherein the transistor device is maintained in a triode region using a third voltage associated with the second current; and wherein the resistance of the transistor device shares characteristics of a resistance of the external resistor.

2. The system of claim 1, wherein the current generation circuit comprises:

a feedback amplifier coupled to a first transistor device; and the external resistor coupled to the first transistor device, wherein the first voltage is an input to the feedback amplifier; and wherein the first transistor device forwards the first current.

3. The system of claim 1, wherein the external resistor is coupled to a node of the first voltage via an external pin.

4. The system of claim 1, wherein the first current is equivalent to the second current.

5. The system of claim 1, wherein the at least one bias generation circuit comprises a constant bias current generation circuit, comprising:

a first transistor device and the transistor device coupled in series; and a feedback amplifier coupled to the first transistor device and to the transistor device, wherein the first voltage is generated by a constant voltage source;

wherein a fraction of the first voltage is an input to the feedback amplifier; and wherein the second current is the bias current.

6. The system of claim 5, wherein the first voltage comprises a bandgap voltage independent of temperature.

7. The system of claim 1, wherein the fraction of the first voltage is obtained using a resistance divider circuit.

8. The system of claim 1, wherein the at least one bias generation circuit comprises a PTAT current generation circuit, comprising:

a first BJT device, a first CMOS device and a third CMOS device coupled in series;

a second BJT device, the transistor device, a second CMOS device and a fourth CMOS device coupled in series;

a third BJT device and a fifth CMOS device coupled in series, wherein an emitter of the third BJT device is coupled to a gate of the transistor device; and wherein the bias current is based on a difference between a base-to-emitter voltage of the first BJT device and a base-to-emitter voltage of the second BJT device over the resistance of the transistor device.

9. A bias current generation system, comprising:

a constant current generation circuit generating a first constant current based on a first constant voltage and an external resistor;

a current mirror forwarding a second constant current proportional to the first constant current;

a constant bias current generation circuit generating a constant bias current based on a second constant voltage over a resistance of a first transistor device, wherein the first transistor device is maintained in a triode region using a third constant voltage associated with the second constant current; and wherein the resistance of the first transistor device shares characteristics of a resistance of the external resistor; and a PTAT bias current generation circuit generating a PTAT bias current based on a first PTAT voltage over a resistance of a second transistor device, wherein the second transistor device is maintained in a triode region; and wherein the resistance of the second transistor device shares characteristics of a resistance of the external resistor.

10. The system of claim 9, wherein the constant current generation circuit comprises:

a feedback amplifier coupled to a third transistor device; and the external resistor coupled to the third transistor device, wherein the first constant voltage is an input to the feedback amplifier; and wherein the third transistor device forwards the first constant current.

11. The system of claim 9, wherein the constant bias current generation circuit comprises:

a third transistor device and the first transistor device coupled in series; and a feedback amplifier coupled to the third transistor device and the first transistor device, wherein a fraction of the first constant voltage is an input to the feedback amplifier; and wherein the second constant current is the constant bias current.

12. The system of claim 11, wherein the fraction of the first constant voltage is obtained using a resistance divider circuit.

13. The system of claim 9, wherein the PTAT current generation circuit comprises:

a first BJT device, a first CMOS device and a third CMOS device coupled in series;

a second BJT device, the second transistor device, a second CMOS device and a fourth CMOS device coupled in series; and a third BJT device and a fifth CMOS device coupled in series, wherein an emitter of the third BJT device is coupled to a gate of the second transistor device; and wherein the PTAT bias current is based on a difference between a base-to-emitter voltage of the first BJT device and a base-to-emitter voltage of the second BJT device over the resistance of the second transistor device.

14. The system of claim 9, wherein the constant bias current generation circuit is coupled to the PTAT bias current generation circuit via a feedback amplifier.

15. The system of claim 9, wherein the resistance of the first transistor device is proportional to the second transistor device.

16. The system of claim 15, wherein a gate length of the first transistor device is same as a gate length of the second transistor device.

17. The system of claim 16, wherein a ratio of the resistance of the first transistor device to the resistance of the second transistor device is determined by a gate width of the first transistor device and a gate width of the second transistor device.

18. A bias current generation circuit, comprising:

a constant current generation circuit generating a first constant current based on a first constant voltage and an external resistor, the constant current generation circuit comprising:

a feedback amplifier coupled to a first transistor device; and the external resistor coupled to the first transistor device, wherein the first constant voltage is an input to the feedback amplifier;

and wherein the first transistor device forwards the first constant current;

a current mirror forwarding a second constant current proportional to the first constant current;

a constant bias current generation circuit generating a constant bias current based on a second constant voltage over a resistance of a second transistor device, wherein the second transistor device is maintained in a triode region using a third constant voltage associated with the second constant current; and wherein the resistance of the second transistor device shares characteristics of a resistance of the external resistor; and a PTAT bias current generation circuit generating a PTAT bias current based on a first PTAT voltage over a resistance of a third transistor device, wherein the third transistor device is maintained in a triode region; and wherein the resistance of the third transistor device shares characteristics of a resistance of the external resistor.

19. The circuit of claim 18, wherein the constant bias current generation circuit comprises:

a fourth transistor device and the second transistor device coupled in series; and a first feedback amplifier coupled to the fourth transistor device and the second transistor device, wherein a fraction of the first constant voltage is an input to the first feedback amplifier; and wherein the second constant current is the constant bias current.

20. The circuit of claim 18, wherein the PTAT bias current generation circuit comprises:

a first BJT device, a first CMOS device and a third CMOS device coupled in series;

a second BJT device, the third transistor device, a second CMOS device and a fourth CMOS device coupled in series; and a third BJT device and a firth CMOS device coupled in series, wherein an emitter of the third BJT device is coupled to a gate of the third transistor device; and wherein the PTAT bias current is based on a difference between a base-to-emitter voltage of the first BJT device and a base-to-emitter voltage of the second BJT device over the resistance of the third transistor device.

* * * * *